United States Patent [19]

Becker

[11] 4,024,827

[45] May 24, 1977

[54] VESSEL RUDDER ASSEMBLY, PARTICULARLY A BALANCE TYPE PROFILE RUDDER WITH A FIN

[76] Inventor: Willi Becker, Danziger Str. 22, 2000 Hamburg 1, Germany

[22] Filed: Dec. 19, 1975

[21] Appl. No.: 642,386

[30] Foreign Application Priority Data

Dec. 8, 1975 Germany ..... 2555098

[52] U.S. Cl. ..... 114/162; 114/165

[51] Int. Cl.[2] ..... B63H 25/06

[58] Field of Search ..... 114/162, 163, 164, 165, 114/169

[56] References Cited

UNITED STATES PATENTS

| | | | |
|---|---|---|---|
| 1,515,024 | 11/1924 | Flettner | 114/163 |
| 1,958,302 | 5/1934 | Hanlon | 114/165 |
| 2,545,502 | 3/1951 | Troester | 114/169 |
| 3,757,720 | 9/1973 | Fischer | 114/163 X |

*Primary Examiner*—Trygve M. Blix
*Assistant Examiner*—Sherman D. Basinger
*Attorney, Agent, or Firm*—Toren, McGeady and Stanger

[57] ABSTRACT

A vessel rudder assembly including a rudder stock bearing, a rudder shaft and a rudder blade whereby the rudder stock bearing is in the form of a cantilever beam including an internal bore through which the rudder shaft extends the rudder blade is connected to the free end of the rudder shaft, and the rudder stock bearing includes at least one rudder bearing. This rudder bearing may be mounted within the rudder stock bearing internal bore.

4 Claims, 3 Drawing Figures

Figure 1:
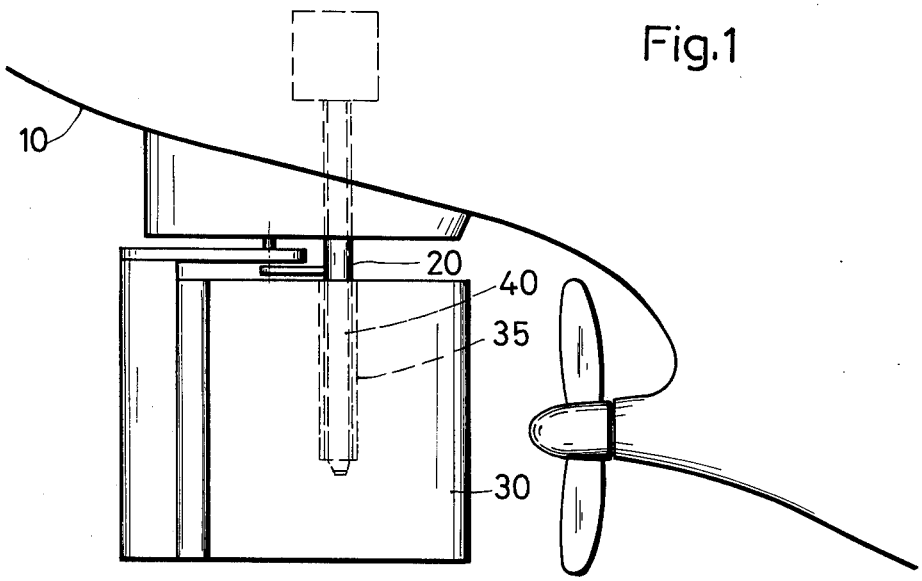

10
20a
20

40
30
25
III
III
35
20
20b
51
50
40a

VESSEL RUDDER ASSEMBLY, PARTICULARLY A BALANCE TYPE PROFILE RUDDER WITH A FIN

The present invention relates generally to rudders of ships or vessels, and particularly to rudders of the balance profile type with a fin.

Extremely high flexural torques or bending moments are transmitted to the body of a ship having a fully floating rudder or a balance type profile rudder with a fin. These torques are produced by the resultant rudder loads acting on the rudder stock bearing. These biaxial stresses in combination with the driving torques required for actuating the rudder determine the design rudder stock corss section within the rudder stock bearing as well as the dimensions of the bearing and the dimensions in the connecting region with the rudder stock, and thereby also the profile thickness of the rudder.

Fully floating rudders that are favorable with respect to flow conditions and particularly fully floating high power ship's rudders with additional articulated back or leading edge wings are conventionally journalled in cast and/or welded material rudder stock bearings, and these bearings are accommodated at the ship's stern above the counter or above the flat bottom or within a counter fin mounted in the ship's body.

In semifloating rudders, flexural torques are transmitted to a rudder post that is integrally connected with the ship's body. Large rudders, however, are mounted in hoe type bearings.

In a heretofore known lockable steering rudder arrangement, the ship's body is provided with a sleeve shaped rudder stock bearing for journalling the rudder shaft. The rudder shaft extends into the rudder blade and consists of several mutually spaced horizontal webs. These webs are encased between lateral sheet coverings. A rudder shaft portion which extends into the rudder blade is welded to the webs so that not only torques but likewise bending moments are transmitted to the rudder shaft. An example of such an arrangement is disclosed e.g. in German patent 1,916,392.

The design of the bearings of fully floating rudders and of balance type profile rudders with a fin is such that flexural torques in the rudder increase up to a maximum in the region of the rudder stock bearing and have to be absorbed by the rudder shaft member, with the result that very large diameter rudder shafts are required. The required large rudder shaft diameters and the corresponding dimensions of the bearings are necessarily subject to an upper limit which corresponds to ship's sizes having a tonnage of about 15,000 tons.

The splitting of biaxial stresses in semifloating rudders leads to hydrodynamically unfavorable asymmetrical characteristics, due to the rigidy mounted upper post and the cleavage effects occurring above the movable lower balance surface. Frequently, the developed rudder moments are highly asymmetrical, due to the swirl flow caused by the propeller. For this reason, there are required relatively high powered servo units for actuating the rudder.

Displacement type rudders with hoe type bearings have the disadvantage that the wake distribution pattern at the propeller is unfavorably interfered with, and the drag resistance is increased.

It is, therefore, an object of the present invention to provide a novel and improved rudder assembly for vessels.

It is another object of the present invention to provide an improved rudder assembly for vessels, particularly for solid and for multi-sectional fully floating rudders and for balance type profile rudders with a fin.

It is still another object of the present invention to provide an improved rudder assembly with an improved design of the rudder stock bearing wherein the bending moments which would otherwise be transmitted to the rudder stock bearing via the rudder shaft, and subsequently transmitted by the rudder stock bearing into the ship's body are directly absorbed at the rudder, in thereby relieving stresses on the rudder shaft, with the aims of allowing a simpler design of the connection between the smaller diameter rudder shaft and the rudder on the one hand, and the actuating of the rudder by less powerful steering engines on the other hand.

In accordance with the present invention there is now proposed a vessel rudder assembly, particularly for a balance type profile rudder with a fin, the assembly including a rudder stock bearing, a rudder shaft and a rudder blade wherein the rudder stock bearing is in the form of a cantilever beam with an internal bore for accommodating the rudder shaft, and extends into the rudder blade that is connected to the free end of the rudder shaft, and wherein the rudder stock bearing includes at least one rudder bearing.

For achieving a predetermined elastic coupling between the rudder blade and the rudder stock bearing on the one hand and the rudder shaft journalled in the immediate vicinity of the steering engine on the other hand, the invention furthermore proposes to mount at least one bearing for journalling the rudder shaft within the internal bore of the rudder stock bearing.

The rudder assembly of the present invention allows rudder designs at the stern of a ship in which the rudder stock bearing extends into the rudder blade along a depth limited only by design and manufacturing considerations. In accordance with another embodiment, the present invention, therefore, additionally provides that the rudder stock bearing extends into the rudder blade along a depth corresponding to more than half the height of the rudder blade.

The advantages obtained in a vessel rudder assembly according to the present invention are to considerably enlarge the range of applications of fully floating rudders and of balance type profile rudders with a fin in either subdivided or solid assemblies with respect to technically feasible rudder sizes. This advantageous result is achieved by separating the biaxial stresses whereby the bending momment is absorbed by the rudder stock bearing extending into the rudder blade, and this bending moment is transmitted into the ship's body. The rudder actuating torque is transmitted along the elongated rudder shaft. With a given rudder surface, the rudder profiles may thus be slimmed down so that correspondingly there results a lower drag resistance. Moreover, the connection between rudder and rudder stock is less expensive in production, and the assembly is simplified. The proposed rudder assembly furthermore permits to save on investment and assembly costs for the scaled-down rudder stock bearing. Since bending moments and torques are separated from each other, the bearings are no longer subject to bending loads, and may thus be designed in smaller sizes.

Figure 3:
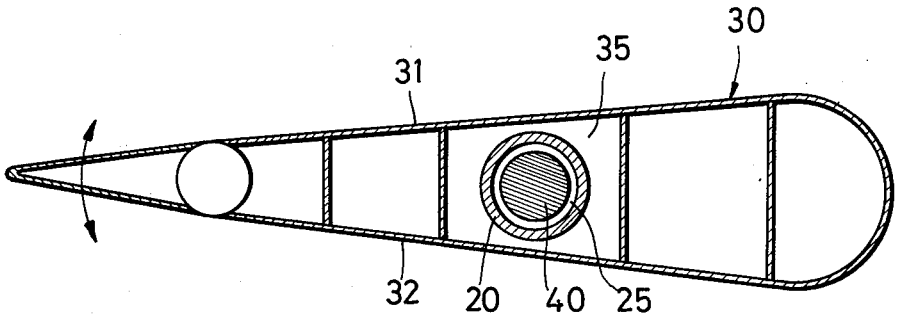
Figure 2:
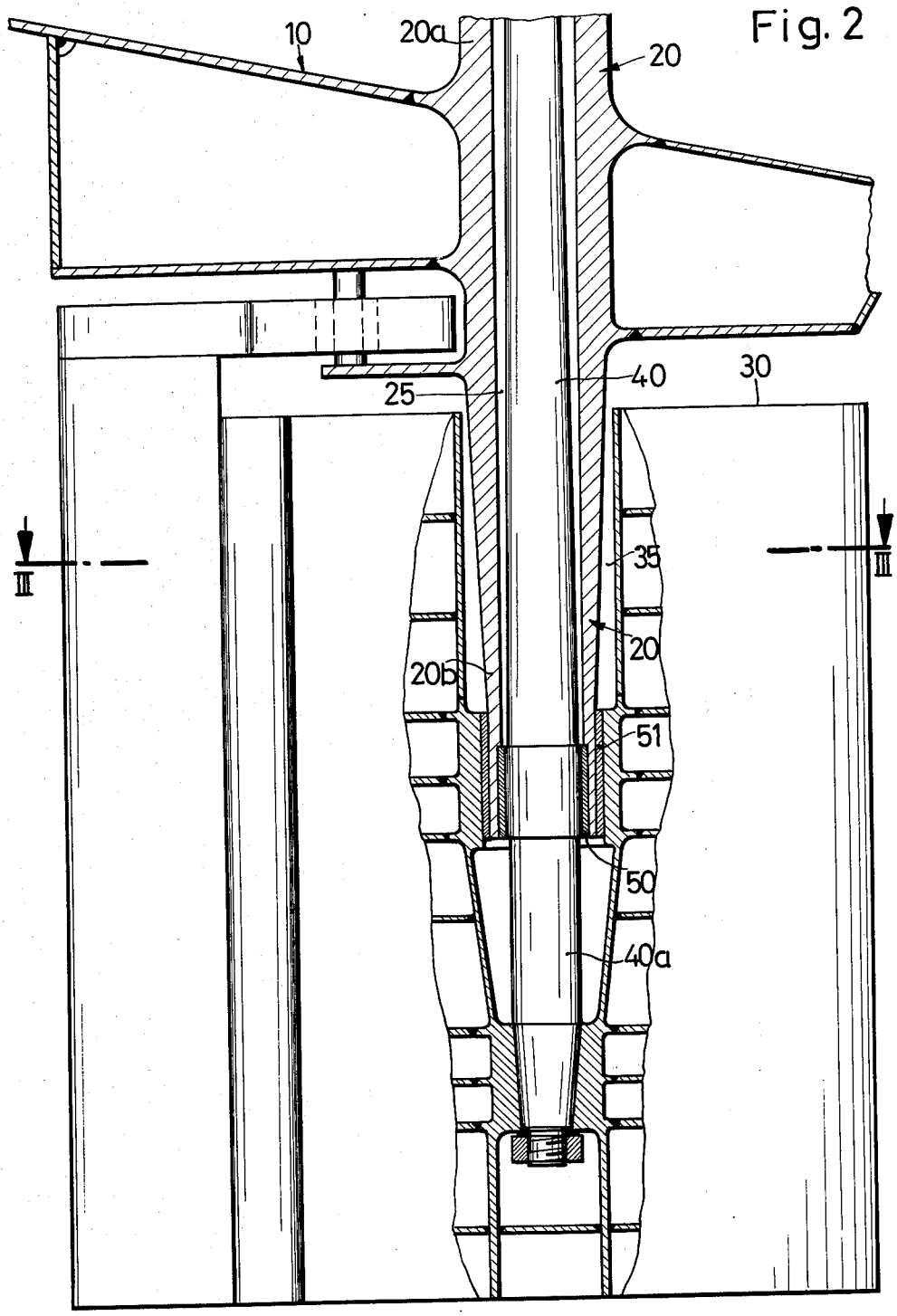

In the following, the vessel rudder assembly of the present invention will be described with reference to the appended drawings illustrating a preferred embodiment of the present invention. In the drawings FIG. 1 is a lateral elevational view of a vessel rudder assembly of the present invention, mounted at the stern of a vessel;

FIG. 2 is an enlarged elevational view of the rudder assembly, shown partly in elevation and partly in cross section; and FIG. 3 is a horizontal cross sectional view along the line III—III of FIG. 2.

Referring to FIGS. 1 and 2, the embodiment of the inventive vessel rudder assembly shown therein generally illustrates by the reference numeral 10 part of a body of a ship, by 20 a rudder stock bearing, by 30 a rudder blade, and by 40 a rudder shaft.

The rudder stock bearing 20 is in the form of a cantilever beam and is rigidly mounted at the ship's body 10 by its inner end 20*a*. The rudder stock bearing 20 includes an internal bore 25 for accommodating the rudder shaft 40. The rudder stock bearing 20 extends into the rudder blade 30, and the rudder shaft 40 is securely connected at its free lower end 40*a* to the rudder blade 30. The rudder shaft 40 is accommodated within the internal bore 25 of the rudder stock bearing 20.

The rudder blade 30 includes a preferably cylindrical recess 35 for receiving the free end 20*b* of the rudder stock bearing 20. This recess 35 is delimited by the lateral sheet coverings 31, 32 (see FIG. 3).

In the embodiment shown in FIG. 2 the rudder stock bearing 20 extends into the rudder blade 30 by more than half the height of the rudder blade 30. The invention, however, is not dependent upon this characteristic, and the portion of the rudder stock bearing extending into the rudder blade 30 may correspond to more or less than half the height of the rudder blade 30.

For journalling the rudder shaft 40, the rudder stock bearing 20 is provided with at least one bearing within the internal bore 25 of the bearing 20. As may be seen in FIG. 2, there may be provided at the lower end of the rudder stock bearing 20, within the internal bore 25, an inner bearing 50, and at the outer circumference of the rudder stock bearing 20, an outer bearing 51. It would likewise be possible to provide in the rudder stock bearing 20 one or several bearings spaced along the length of the rudder shaft 40. For achieving small width dimensions of the rudder blade, the outer wall of the rudder stock bearing 20 may be conically tapered toward the free end 20*b* of the rudder stock bearing.

The present invention is not restricted to the above described and illustrated embodiment. It is considered to be within the scope of the present invention to modify the arrangement of the bearing within the rudder shaft bearing 20 and at the rudder stock 40, and to provide in the rudder blade 30 a recess 35 having a non-cylindrical configuration.

The vessel rudder assembly of the present invention may be employed in vessels or ships of any type as well as in floating platform and the like.

THE EMBODIMENTS IN WHICH AN EXCLUSIVE PROPERTY OR PRIVILEGE IS CLAIMED ARE DEFINED AS FOLLOWS:

1. A vessel rudder assembly, particularly for a balance type profile rudder with a fin, the assembly including a rudder stock bearing, a rudder shaft and a rudder blade, wherein the improvement comprises that said rudder blade having an upper end and a lower end with a recess extending downwardly from the upper end thereof, said rudder stock bearing being upright and having an upper end arranged to be fastened to the hull of a vessel and a lower end, said rubber stock bearing extending downwardly into the recess in said rubber blade with the upper end thereof located above said rudder blade and the lower end located within the recess in said blade, said rudder stock bearing having a tubular shape with said rudder shaft extending downwardly through said rudder stock bearing into said rudder blade with the lower end of said rudder shaft located within said recess in said rudder blade below the lower end of said rudder stock bearing, said rudder blade being suspended from said rudder shaft with the lower end of said shaft being rigidly joined to said rudder blade, and at least one rudder shaft bearing for said rudder shaft located within said rudder stock bearing in the portion thereof extending downwardly into said rudder blade.

2. A vessel rudder assembly according to claim 1, wherein said at least onerudder bearing forms an inner bearing within said rudder stock bearing, and an outer bearing located radially outwardly from said inner bearing and positioned between the lower end of said rudder stock bearing and said rudder blade.

3. A vessel rudder assembly according to claim 2, wherein the rudder stock bearing extends into the rudder blade along a depth corresponding to more than half the height of the rudder blade.

4. A vessel rudder assembly according to claim 3, wherein the rudder stock bearing includes an outer wall which is conically tapered toward the free end of the rudder stock bearing.

* * * * *